US007910883B2

(12) United States Patent
Muehlberger et al.

(10) Patent No.: US 7,910,883 B2
(45) Date of Patent: Mar. 22, 2011

(54) METHOD AND DEVICE FOR THE MASS SPECTROMETRIC DETECTION OF COMPOUNDS

(75) Inventors: Fabian Muehlberger, Freising (DE); Ralf Zimmermann, Bergisch-Gladbach (DE)

(73) Assignee: Helmholtz Zentrum Muenchen Deutsches Forschungszentrum fuer Gesundheit und Umwelt (GmbH), Munich (DE)

( * ) Notice: Subject to any disclaimer, the term of this patent is extended or adjusted under 35 U.S.C. 154(b) by 400 days.

(21) Appl. No.: 12/064,124

(22) PCT Filed: Aug. 5, 2006

(86) PCT No.: PCT/EP2006/007773

§ 371 (c)(1),
(2), (4) Date: Jul. 29, 2008

(87) PCT Pub. No.: WO2007/019982

PCT Pub. Date: Feb. 22, 2007

(65) Prior Publication Data

US 2009/0218482 A1 Sep. 3, 2009

(30) Foreign Application Priority Data

Aug. 19, 2005 (DE) ..... 10 2005 039 269

(51) Int. Cl.
*H01J 49/10* (2006.01)
*H01J 49/16* (2006.01)

(52) U.S. Cl. ..... 250/288; 250/282; 250/423 P

(58) Field of Classification Search ..... 250/281, 250/282, 288, 423 P
See application file for complete search history.

(56) References Cited

U.S. PATENT DOCUMENTS

| | | | | |
|---|---|---|---|---|
| 5,206,594 | A * | 4/1993 | Zipf | 250/423 P |
| 5,397,895 | A | 3/1995 | Leone et al. | |
| 5,763,875 | A | 6/1998 | Kaesdorf et al. | |
| 6,211,516 | B1 * | 4/2001 | Syage et al. | 250/288 |
| 6,727,499 | B2 | 4/2004 | Zimmermann et al. | |
| 2002/0104962 | A1 * | 8/2002 | Danno et al. | 250/288 |

FOREIGN PATENT DOCUMENTS

| | | |
|---|---|---|
| DE | 10014847 | 10/2001 |
| DE | 10044655 | 4/2002 |

* cited by examiner

*Primary Examiner* — Jack I Berman
(74) *Attorney, Agent, or Firm* — Leydig, Voit & Mayer, Ltd.

(57) ABSTRACT

A method for mass-spectrometric detection of compounds in a gas flow includes: alternatingly forming first and a second beams by switching between electron pulses/pulse trains and photon pulses/pulse trains, the photon pulses/pulse trains being generated by an excimer lamp, and the switching between the electron pulses/pulse trains and the photon pulses/pulse trains occurring at a switching frequency above 50 Hz; disposing the gas flow in an ionization region crossed by the first and second beams so as to ionize volume units in the gas flow so as to form ions of the compounds; deflecting the ions in an effective region of an electric field to a mass-spectrometric device; and sensing the ions with a mass-spectrometric process of the mass-spectrometric device.

17 Claims, 2 Drawing Sheets

METHOD AND DEVICE FOR THE MASS SPECTROMETRIC DETECTION OF COMPOUNDS

CROSS REFERENCE TO RELATED APPLICATION

This is a U.S. national phase application under 35 U.S.C. §371 of International Patent Application No. PCT/EP2006/007773, filed Aug. 5, 2006, and claims benefit of German Patent Application No. 10 2005 039 269.5, filed Aug. 19, 2005. The International Application was published in German on Feb. 22, 2007 as WO 2007/019982 under PCT Article 21(2).

FIELD

The invention relates to a method and an apparatus for mass-spectrometric detection of compounds in a gas flow.

BACKGROUND

A gas sample can be made up of a plurality of atoms, molecules, and chemical compounds. In the context of a mass-spectrometric detection, ionization of a sample is accomplished via photon and/or electron irradiation; depending on the nature and intensity of the irradiation, a selective ionization of the various atoms, molecules, or chemical compounds, or a fragmentation of molecules and compounds, can take place. The ions that are generated are deflected by an electric field and conveyed to a mass-spectrometric detection system.

The resonance-enhanced multi-photon ionization technique (REMPI), which utilizes UV laser pulses (soft photoionization) for selective ionization of, for example, aromatic compounds, is used as a soft and selective ionization method for mass spectrometry. The selectivity is determined by, among other factors, the soft UV spectroscopic properties and the location of the ionization potentials. The REMPI method is disadvantageous in that it is limited to certain substance classes, and the ionization cross section can in some cases be extremely different even for similar compounds.

Single photon ionization (SPI) using VUV laser light likewise permits partially selective and soft ionization. Selectivity is determined by the location of the ionization potentials. A typical application is the detection of compounds that cannot be detected using REMPI. The SPI method is disadvantageous in that here as well, some substance classes cannot be detected. In addition, selectivity is lower than with the REMPI method, so that greater interference can occur with complex samples.

On the other hand, the unselective but fragmenting electron impact (EI) ionization method using an electron beam is a standard technique in mass spectrometry for ionization in particular of volatile inorganic and organic compounds. It acts on all substances (i.e. not selectively), and with many molecules often results in extreme fragmentation. It is particularly suitable for detecting compounds (such as e.g. $O_2$, $N_2$, $CO_2$, $SO_2$, CO, $C_2H_2$) that are difficult to sense by photon ionization as mentioned above using UV and VUV radiation (SPI, REMPI).

When a gas sample having a plurality of compounds is ionized using the SPI method, however, it can happen that multiple compounds having the same mass are ionized, and therefore cannot resolved mass-spectrometrically. With EI ionization of a gas sample having a plurality of compounds, it can happen that multiple compounds having the same mass and/or a similar fragmentation pattern are ionized, and here as well individual compounds cannot be resolved. It is useful in this respect to direct the gas sample through a gas chromatograph (GC) capillary for preselection of the compounds, so as thereby to achieve in the gas flow a time offset, which can be traced back and thus allocated to the individual compounds, between the compounds before admission into the ionization chamber.

Proceeding from the aforementioned types of irradiation, DE 100 14 847 A1 describes a technology for detecting compounds from a gas flow, which technology utilizes a combination of the aforesaid SPI and REMPI ionization. Alternating irradiation of a continuous gas flow with REMPI and SPI ionization pulses (UV and VUV laser pulses, respectively) is performed in this context, a separate isolated volume element being ionized with each pulse and conveyed to a mass spectrometer. All the laser pulses are generated with the aid of a configuration having solid-state lasers and having a plurality of optical elements that are in part also modifiable.

With the aforementioned technology, however, only selective types of radiation are used, so that certain substances that are ionizable only by an electron beam are not sensed. In addition, the ions are generated in this case exclusively by laser pulses on the axis of the time-of-flight mass spectrometer. Continuous ion sources cannot be used here.

The solid-state lasers used to generate UV or VUV irradiation also have only a very limited repetition rate in the region of 50 Hz. If the compounds of a gas flow are first preselected in a GC capillary, however, changes in the gas-flow composition (typically with very brief concentration peaks) may be expected; this requires an enhanced time resolution and redundant measurements in rapid sequence. A repetition rate of the aforesaid magnitude is no longer sufficient, however, and results in incorrect measurements.

In addition, ordinary (i.e. non-tunable) solid-state lasers generate only one wavelength, which necessitates the aforementioned complex configuration having a number of optical elements.

SUMMARY

It is an aspect of the present invention to provide a method and an apparatus for detecting compounds from a gas flow having an expanded measurement range and a considerably improved time resolution capability.

In an embodiment the present invention provides a method for mass-spectrometric detection of compounds in a gas flow. The method includes: alternatingly forming first and a second beams by switching between electron pulses/pulse trains and photon pulses/pulse trains, the photon pulses/pulse trains being generated by an excimer lamp, and the switching between the electron pulses/pulse trains and the photon pulses/pulse trains occurring at a switching frequency above 50 Hz; disposing the gas flow in an ionization region crossed by the first and second beams so as to ionize volume units in the gas flow so as to form ions of the compounds; deflecting the ions in an effective region of an electric field to a mass-spectrometric device; and sensing the ions with a mass-spectrometric process of the mass-spectrometric device.

BRIEF DESCRIPTION OF THE DRAWINGS

Aspects of the present invention will now be described by way of exemplary embodiments with reference to the following drawings, in which.

DETAILED DESCRIPTION

Figure 1:
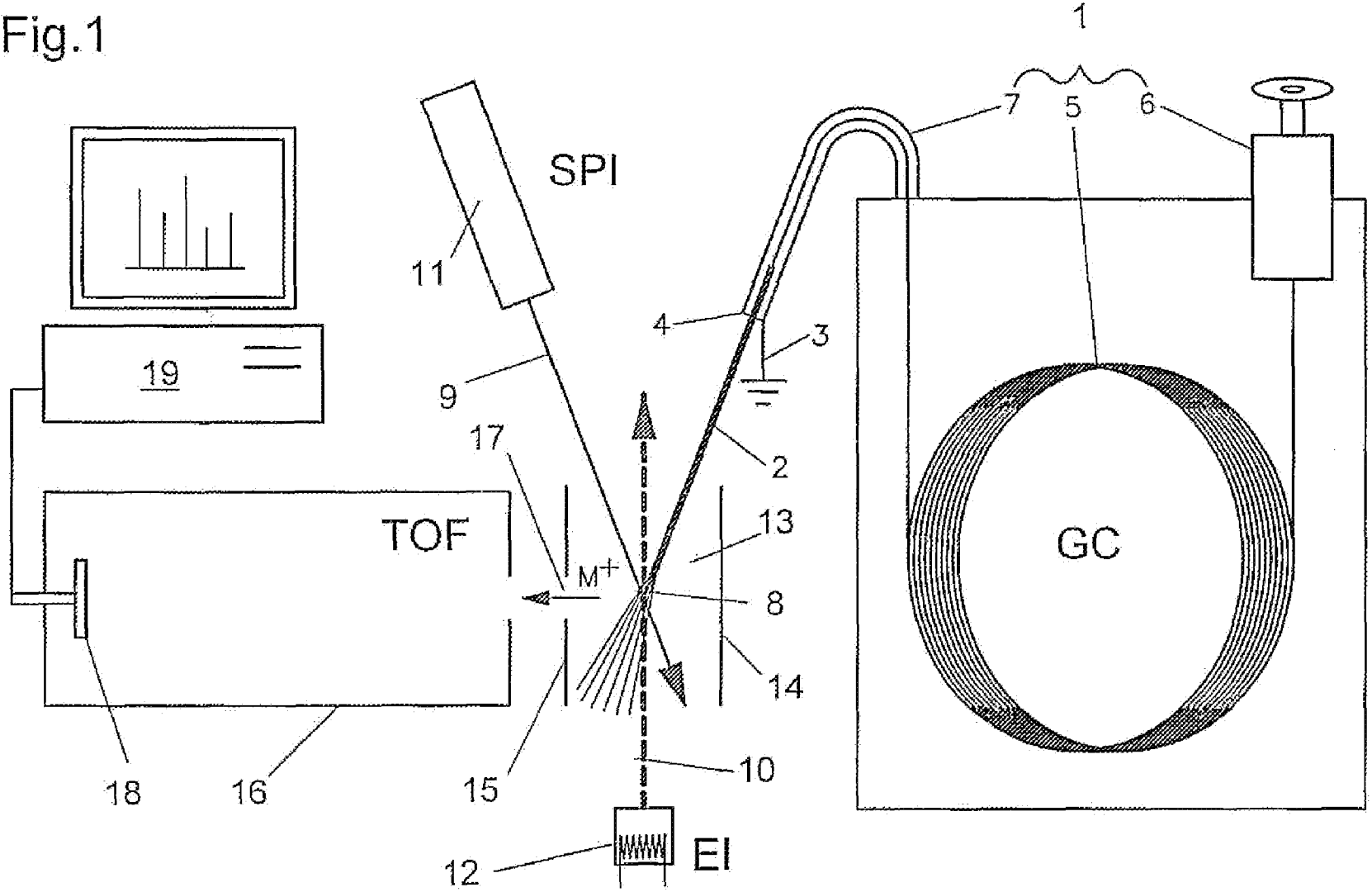
FIG. 1 is a schematic configuration of a GC/EI/SPI apparatus according to an exemplary embodiment of the present invention.

A method and apparatus are provided for mass-spectrometric detection of compounds in a gas flow.

A method is provided that includes an ionization of volume units in a gas flow with the formation of ions of the compounds, the ionization being accomplished via beams crossing the gas flow that are alternatingly formed upon switching between electron and photon pulses or pulse trains thereof (i.e. electron pulses or electron pulse trains and photon pulses or photon pulse trains). The volume units are self-contained gas-flow portions that are defined in their volumetric extension by the gas flow and the duration and penetration of the respectively activated beams crossing the gas flow. The gas flow is continuous, i.e. with no interruption in flow, and is directed from a supply conduit, by preference a capillary, into the crossing region between the gas flow and the beams.

What is important in this context is a high timing frequency of over 50 Hz, by preference over 100 Hz (switching frequency of the switchover between photon and electron pulses), for the alternating switching between electron and photon pulses or pulse trains thereof. It is additionally preferred that between the switchings, the gas flow be irradiated with VUV light or electrons either continuously (as pulses) or at frequencies up to 150 kHz, preferably up to 100 kHz (as pulse trains, repetition rate). It is possible in particular to generate a photon pulse train in only very limited fashion, i.e. at much lower frequencies (laser repetition rates up to a maximum of approx. 4 kHz), using a laser such as, for example, an excimer laser. Lasers are particularly suitable for generating monochromatic photon radiation at very high energy and quality into the UV region ($\lambda$>193 nm), but not, because of poor transmission properties in glasses and crystals, for generating photons in the VUV region ($\lambda$<157 nm). A further important feature of the invention therefore includes the arrangement for generating the vacuum UV (VUV) photon pulses by preferably a electron-beam-pumped excimer lamp. An electron-beam-pumped excimer lamp has a brilliant illumination point, i.e. it generates a single-point and therefore more easily focusable photon radiation, and differs thereby from discharge excimer lamps. Electron-beam-pumped excimer lamps also generate a more precise monochromatic emission spectrum.

In a gas-filled space, impacts with accelerated electrons cause the formation of energetically excited noble-gas atoms or molecules (e.g. $Ar^+$, $Kr^+$ or $NeH_2$); depending on the gas filling pressure, the electrons react with noble-gas or halogen atoms to form excimers (excited dimers) or exciplexes (excited complexes). Light emission occurs at a specific characteristic wavelength below 150 nm upon spontaneous decay of these excimers (e.g. $Ar^+$: $\lambda_{max}$=126 nm; $Kr^+$: $\lambda_{max}$=150 nm) or exciplexes ($NeH_2$: $\lambda_{max}$-121.6 nm); their average lifespan in the range of a few nanoseconds is the critical factor making possible the aforesaid maximum repetition rate.

Excimer lamps generate VUV radiation continuously or as pulse trains having a repetition rate, but have too low an intensity in the UV region for resonance-enhanced multiphoton ionization (REMPI); a considerable limitation of the method (i.e. to an SPI-EI combination) might therefore be expected. The detection sensitivity can be significantly improved, by statistical means, by way of an aforementioned photon pulse train having a plurality of identical individual pulses, and by way of the number of redundant individual measured values thereby obtained.

In order to generate triggering of the electric field for the mass spectrometer and the timing frequency for the pulses and pulse trains, as well as repetition rates for the pulse trains, the apparatus comprises a switchover apparatus (trigger circuit), preferably based on a fast process computer.

It is important, in the context of continuous ionization between the switchings, that the ion flow be directly continuously through the ion extraction region of a mass spectrometer (time-of-flight mass spectrometer), and that ion packets be extracted there into the mass spectrometer at high frequency.

Ionization is followed by a deflection of the ions (ionized compounds and compound fragments) by an electric field (ion extraction field) to a mass-spectrometric system in order to sense the ions using a mass-spectrometric process. Ionization preferably takes place directly in an electric field.

What is important in this context, however, is that—especially in the context of the aforementioned elevated timing frequencies and the relatively low photon pulse intensity of the excimer lamps used—the electric field be activated with a time offset with respect to the photon and electron pulses, in timed fashion at the aforesaid timing frequency.

Short pulses and a defined extraction of the ions from the beam result advantageously in considerably improved mass resolution in the mass spectrometer (time-of-flight mass spectrometer). The time-related measurement resolution can be improved, on the other hand, with high timing frequencies. Reference is made to the possibility of, for example, combining multiple individual measured values for trend prediction, averaging individual data of multiple individual spectra, and integrating individual measured values over time, i.e. to individual evaluation in substantially expanded form.

The gas-flow constituents that are not ionized by the aforesaid electron or photon pulses behave neutrally in an electric field and are also not deflected. They can be acted upon and ionized again, after extraction of the ions in the electric field, with a second electron or photon pulse (second beam) of a different energy density or wavelength; the ions that then occur can be deflected in a second electric field (ion extraction field) to a mass-spectrometric system for sensing of the ions using a mass-spectrometric process. This method step can also be applied more than twice in succession; preferably, a corresponding control system or pulse triggering system ensures that the second beam senses exclusively volume regions in the aforesaid volume units.

For analysis in the context of certain gas flow compositions, in addition to a preselection of compounds prior to ionization, a configuration of the capillary as a GC capillary is advantageous.

In a further advantageous embodiment, a gravimetric splitting of lighter and heavier compounds is accomplished by way of a small-radius gas flow diverter, e.g. in the capillary, with a subsequent branching of the gas flow into two partial gas flows (separator nozzle), such that each partial gas flow can be separately analyzed with the aforesaid method.

Corresponding combination of the method and apparatus together with a mass spectrometer (TOF) with orthogonal ion generation is likewise within the scope of the invention. In this context, ions are generated in the gas flow in the aforementioned manner using photon and electron pulses or pulse trains thereof, albeit not directly in the pulsed ion extraction field but rather in the gas flow before the ion extraction field.

Before entering the ion extraction field, the ions are directed through electrostatic ion lenses, the ions being focused. The advantage of this prefocusing is the high density and spatial resolution of the ions upon reaching the electrical extraction field, thus resulting in higher selectivity and mass resolution. This represents an improvement especially when a continuously illuminating excimer lamp is used.

The apparatus according to the exemplifying embodiment depicted in FIG. 1 for detecting compounds from a gas flow encompasses a supply conduit 1 for gas flow 2 having a grounding connection 3 at gas exit opening 4, supply conduit 1 including a gas chromatograph (GC) capillary 5, a gas inlet 6, and a gas outlet 7. After leaving the gas exit opening, the gas flow flows into ionization regions 8, which extends over the penetration volume of gas flow 2 and of photon pulse beams 9 or electron pulse beams 10, depending on the ionization type. The respective ionization of volume units takes place in these ionization regions. Preferably the gas flow, photon pulse beams, and electron pulse beams intersect at a single intersection point, so that the ionization regions for the two aforesaid ionization types are coincident as far as is technically possible.

The apparatus further comprises an excimer lamp 11 and an electron gun 12 for respectively generating photon and electron pulses or pulse trains (photon and electron beam source), for ionizing volume units in the gas flow in order to form ions of the compounds; as previously described, the pulses or pulse trains, constituting photon or electron pulse beams 9 or 10, cross gas flow 2 in ionization region 8.

Ionization region 8 is located in effective region 13 of an electric field that is activatable and deactivatable in pulsed fashion between two acceleration electrons—repeller 14 (positively charged) and extraction electrode 15 (negatively charged)—of a mass-spectrometric system 16 for sensing ions that are accelerated by the aforesaid electric field in the direction of the extraction electrode and deflected out of gas flow 2 through an extraction electrode opening 17 arranged centeredly in the extraction electrode. The mass-spectrometric system is preferably made up of a time-of-flight mass spectrometer for sensing the travel times to ion detector 18 of the ions accelerated in defined fashion in the electric field via an activation pulse magnitude and duration for the electric field. A sensing of the delivered charge of the ions takes place in said detector by way of a downstream, usually PC-assisted data evaluation unit 19. The mass of the detected ions is usually determined by way of the differing times of flight (small masses are accelerated more quickly) that typically range from 5 to 100 microseconds, enabling repetition rates of up to 20 kHz in the present case.

A switchover apparatus is provided for mutually alternating activation of the photon and electron pulses or pulse trains at a switching frequency greater than 50 Hz, preferably approx. 200 Hz. The switchover apparatus, preferably based on a process computer or PC that preferably also encompasses the aforesaid data evaluation unit, likewise serves to control the preferably identical individual pulses that repeat in the context of the aforesaid pulse trains. The switchover apparatus further serves to activate the electric field. Activation begins at a specific time offset from the first pulse after a radiation switching (from photon to neutron radiation or vice versa), and ends before one period length of the switching frequency after said pulse, i.e. beginning with the first pulse of the photon or electron pulses or pulse trains, has elapsed.

Figure 2:
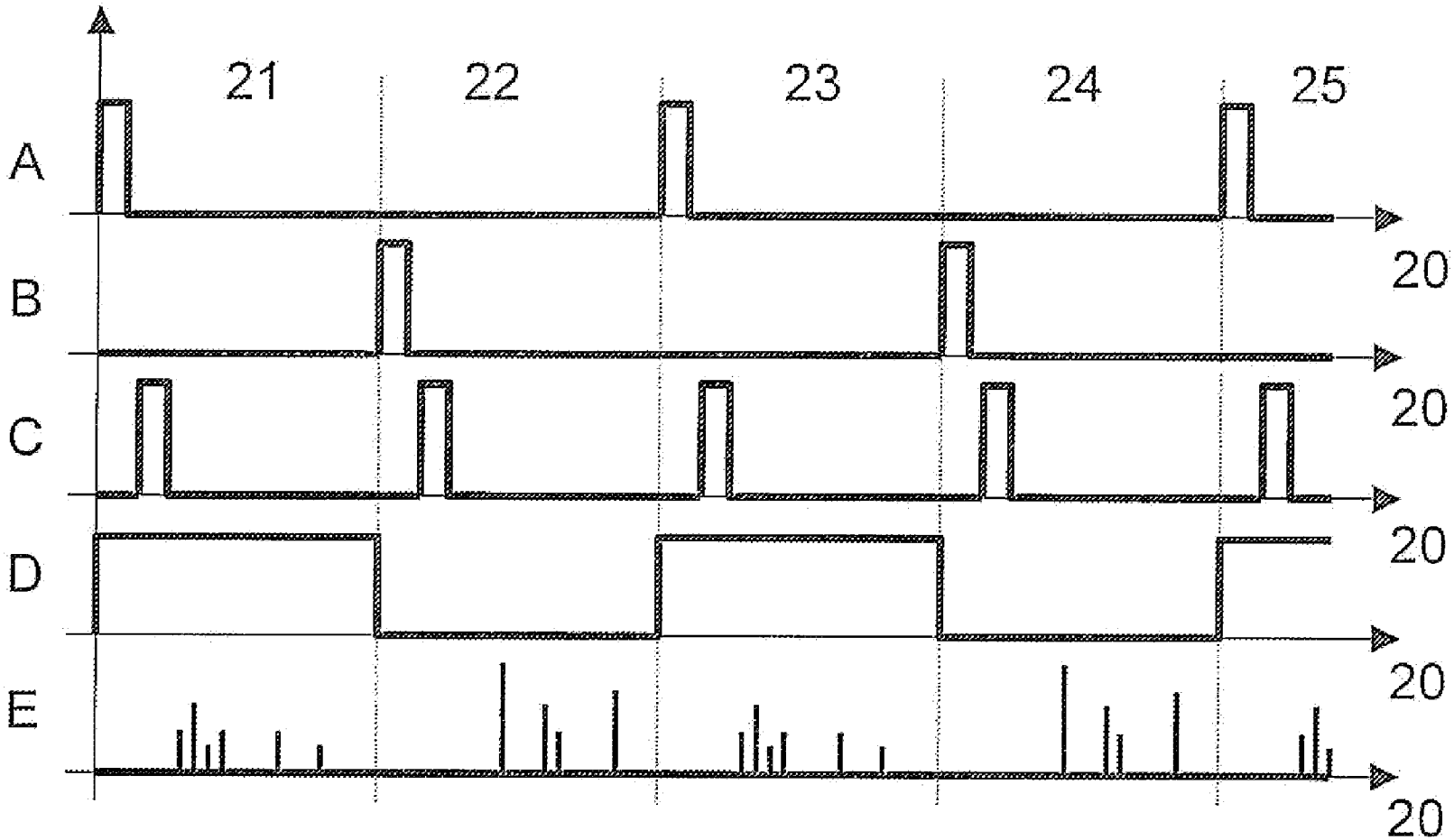
FIG. 2 shows a time sequence of signals sensed mass-spectrometrically and of trigger signals of a switchover apparatus (trigger circuit) according to an exemplary embodiment of the present invention.

FIG. 2 shows, by way of example, the time sequence of the trigger signals of the switchover apparatus (trigger circuit), and of the signals acquired by mass spectrometry. Time axes 20 are divided into several successive sequences 21 to 25, each sequence qualitatively reproducing one period length of the timing frequency for the alternating switching between electron and photon pulses or pulse trains thereof (switching frequency). The vertical axis reproduces trigger pulse height 26; time axes 21 reproduce, for each of the trigger signal profiles A to E depicted, the respective zero level of the qualitatively plotted trigger signal heights ("High" for trigger pulse) and of the detector signals at the ion detector.

Trigger signal profile A reproduces the trigger pulses for the electron gun. In the "High" position, the sample gas is bombarded with an electron pulse or multiple electron pulse trains. Advantageously, the sample gas is bombarded with multiple electron beam pulses during one sequence (21, 23, 25).

Trigger signal profile B reproduces the trigger pulses for the photon source, i.e. the VUV lamp (excimer lamp). In the "High" position, the sample gas is bombarded with a photon pulse (VUV) or preferably multiple photon pulse trains (VUV). Advantageously, the sample gas is bombarded with multiple photon pulses during one sequence (22, 24).

Trigger signal profile C reproduces the trigger pulses for the electric field (ion extraction field). In the "High" position, a pulsed or continuous high voltage in the range of up to 1 kV, but preferably between 200 and 1000 V, is applied between the extraction electrode and repeller, and the ions are extracted in the aforesaid manner into the mass spectrometer (TOF). The ion extraction field is activated with a time offset, but in the present case preferably not necessarily only after completion of the photon or electron pulses or pulse trains.

Trigger signal profile D reproduces the trigger pulses for the data acquisition system. Depending on the switch setting, a signal switch directs the acquired detector signals (mass spectra in accordance with signal profile E) to a data acquisition system for the respective pulse types (e.g. EI or SPI), e.g. to two data acquisition memories and evaluation units (e.g. averaging, in particular for pulse trains). The signal profile reproduces the detector signals from individual pulses.

For mass-spectrometric determination of the ions from electron pulses and photon pulses or with their pulse trains, ionized compounds optionally can be respectively directed to a separate mass spectrometer, the aforesaid switch circuit (signal profile D) being employed to control the electric field; the aforesaid extraction electrode and repeller being acted upon, as electrodes, by a high voltage with a sequentially changing sign; and the two electrodes each being equipped with an ion extraction opening (acting respectively as an extraction electrode opening). Deflection of the ions to one of the mass spectrometers is accomplished solely by way of the orientation of the electric field.

The invention claimed is:

1. A method for mass-spectrometric detection of compounds in a gas flow, the method comprising;

alternatingly forming first and a second beams by switching between electron pulses/pulse trains and photon pulses/pulse trains, the photon pulses/pulse trains being generated by an excimer lamp, and the switching between the electron pulses/pulse trains and the photon pulses/pulse trains occurring at a switching frequency above 50 Hz;

disposing the gas flow in an ionization region crossed by the first and second beams so as to ionize volume units in the gas flow so as to form ions of the compounds;

deflecting the ions in an effective region of an electric field to a mass-spectrometric device; and sensing the ions with a mass-spectrometric process of the mass-spectrometric device.

2. The method according to claim 1, wherein the ionization region is disposed in the effective region.

3. The method according to claim 1, further comprising focusing the ions by beam-shaping electrodes prior to an entry of the ions into the effective region.

4. The method according to claim 1, further comprising directing the gas flow, prior to the ionizing, through a gas chromatograph capillary so as to separate different compounds in the gas flow.

5. The method according to claim 1, further comprising activating the electric field in a timed fashion including a time offset with respect to at least one of the photon pulses/pulse trains and electron pulses/pulse trains, the activating ending before an elapsing of a period length of the switching frequency beginning with the respective photon or electron pulse/pulse train.

6. The method according to claim 1, wherein the mass-spectrometric device includes respective mass spectrometers for the ions of the compounds, respectively.

7. The method according to claim 6, wherein the deflecting is performed so as to deflect the ions to the respective mass spectrometers using an orientation of the electric field.

8. The method according to claim 1, wherein the mass-spectrometric process includes a quantitative determination of individual compounds from multiple individual spectra.

9. The method according to claim 8, wherein the quantitative determination includes an integration of individual measured values for each of the individual compounds over time.

10. The method according to claim 8, wherein the quantitative determination includes an averaging of individual data of the multiple individual spectra.

11. An apparatus for mass-spectrometric detection of compounds in a gas flow, comprising:

a supply conduit configured to supply the gas flow;

a photon device configured to generate photon pulses/pulse trains, the photon device including a photon beam source, the photon beam source including an excimer lamp;

an electron device configured to generate electron pulses/pulse trains;

an ionization region configured to receive respective beams of the photon pulses/pulse trains and electron pulses/pulse trains crossing the gas flow therein so as to ionize volume units in the gas flow so as to form ions of the compounds;

a switchover apparatus configured to alternatingly activate, at a switching frequency greater than 50 Hz., the photon pulses/pulse trains and the electron pulses/pulse trains, the switchover apparatus being configured to activate the electric field in pulsed fashion with a time offset with respect to the respective photon and electron pulses/pulse trains; and an electric field device configured to provide an electric field including an effective region configured to deflect the ions to a mass-spectrometric system configured to sense the ions.

12. The apparatus according to claim 11, wherein the ionization region is disposed in the effective region of the electric field.

13. The apparatus according to claim 11, wherein the ionization region is disposed outside the effective region, and the effective region is configured to receive the gas flow, and further comprising at least one beam shaping electrode disposed between the ionization region and the effective region.

14. The apparatus according to claim 11, wherein the supply conduit includes a gas chromatograph capillary.

15. The apparatus according to claim 11, wherein the switchover apparatus is configured to activate the electric field so that an activation of the electric field ends, for each of the pulse/pulse trains, before a period length of the switching frequency, beginning with at least one of the respective photon and electron pulses/pulse trains, has elapsed.

16. The apparatus according to claim 11, wherein the mass-spectrometric device includes respective mass spectrometers for the ions of the compounds, respectively.

17. The apparatus according to claim 16, wherein the switchover apparatus includes a control system configured to align the electric field based on a deflection of the ions to one of the respective mass spectrometers.

* * * * *